US005901757A

United States Patent [19]

Kidokoro

[11] Patent Number: 5,901,757

[45] Date of Patent: May 11, 1999

[54] WEFT FEED RATE CONTROL METHOD

[75] Inventor: Toshiyuki Kidokoro, Tokyo, Japan

[73] Assignee: Micron Corporation, Tokyo, Japan

[21] Appl. No.: 08/938,745

[22] Filed: Sep. 26, 1997

[51] Int. Cl.[6] ..... D03D 47/30

[52] U.S. Cl. ..... 139/452

[58] Field of Search ..... 139/452, 450

[56] References Cited

U.S. PATENT DOCUMENTS

| | | | |
|---|---|---|---|
| 3,926,224 | 12/1975 | Vermeulen et al. | 139/452 |
| 4,877,064 | 10/1989 | Pezzoli | 139/452 |
| 4,886,094 | 12/1989 | Takegawa | 139/452 |
| 4,921,019 | 5/1990 | Kawabata et al. | 139/452 |
| 5,154,209 | 10/1992 | Takegawa | 139/452 |

*Primary Examiner*—Andy Falik

*Attorney, Agent, or Firm*—Wenderoth, Lind & Ponack, L.L.P.

[57] ABSTRACT

A weft control method capable of adjusting weft feed rate correctly and easily. The control method is for looms which include a weft length measuring system having a length measuring roller 1*a* and a pinch roller 1*b*, a weft feeding system having a gripper (4) and a nozzle (3), and weft arrival sensors (6, 7) installed in a weft arriving position in the loom. In accordance with the weft control method, a weft arrival measurement value measured by weft arrival sensors is stored, an average weft arrival value for a certain number of picks is calculated, then the calculated average arrival value is compared with a preset reference target value; and the weft length measuring system is controlled based on the result of the comparison.

4 Claims, 2 Drawing Sheets

6
8
9
7
Including a data access unit function for detecting optimum conditions for the timing of weft arrival
Residual yarn
Cloth
5
3
14
1b
1a
10
1
2
--> Angle information
<- Change setting of motor speed and pinch roller timing

WEFT FEED RATE CONTROL METHOD

BACKGROUND OF THE INVENTION

1. Field of the Invention

The present invention relates to a weft control method for looms which permits easy adjustment of the length of weft fed from a weft length measuring system in a fluid jet loom.

2. Related Prior Art

With the weft length measuring method on a conventional fluid jet loom, the speed of the weft length measuring drum and the timing of the pinch roller must be adjusted to adjust the weft feed length. Furthermore, electric timing and mechanical adjustment are also required in the case of a drum type length measuring system. These adjustments can take significant amounts of time and a skilled operator is required.

Weft feed rate requires finer adjustment than before since the loom speed and weft inserting speed are faster than before. However, a system to control the weft feed rate easily and correctly has not yet been developed.

SUMMARY OF THE INVENTION

It is an object of the present invention to provide a weft control method to correctly and easily adjust a weft feed rate in accordance with the type of the weft, weaving, change in the diameter of the yarn roll, etc., even when the loom speed is increased.

The present invention was developed in consideration of the above circumstances and intends to solve the problems experienced in the conventional methods by providing a novel weft control method for looms including a weft length measuring system comprising a length measuring roller and a pinch roller, a weft feeding system comprising a gripper and a nozzle, and weft arrival sensors installed in the weft arriving position in the loom. The weft control method for looms includes the steps of storing the weft arrival measurement value measured by the weft arrival sensors, calculating the average weft arrival value for a certain number of picks, comparing the derived average arrival value with a preset reference target value, and controlling the weft length measuring system based on the result of a comparison performed in the preceding process.

According to the present invention, the length of the weft fed from the weft length measuring system is obtained from the weft arrival measurement value that measures the weft arrival timing. The average arrival value is compared with the reference target value. The result of the comparison is fed back to control the weft length measuring system via the control process of the weft length measuring system. Thus, the weft feed rate is automatically adjusted at all times. Furthermore, the impact of occasional extraordinary weft insertions is alleviated, allowing constant and stable adjustment, because the average arrival value calculated for a certain number of picks is used as the arrival measurement value.

DETAILED DESCRIPTION OF THE INVENTION

The present invention is directed to a weft control method for looms which include a weft length measuring system comprising a length measuring roller and a pinch roller, a weft feeding system comprising a gripper and a nozzle, and weft arrival sensors installed in a weft arriving position in the loom.

The weft control method for looms includes the steps of storing the weft arrival measurement value measured by the weft arrival sensors, calculating an average weft arrival value for a certain number of picks, comparing the derived average arrival value with a preset reference target value, and changing an operation program for the length measuring roller and pinch roller based on the result of the comparison performed in the preceding comparing step. The weft average arrival value, measured in the weft arriving position, is compared with the reference target value.

The result of the comparison is fed back to control the length measurement roller and pinch roller via the weft length measurement control unit. It is thus possible, at all times, to automatically adjust the weft feed rate without manual intervention which is necessary in the conventional systems. Furthermore, constant and stable adjustment can be made because the average arrival value calculated for a certain number of picks is used as the measurement value in the comparison with the reference target value.

Figure 1:
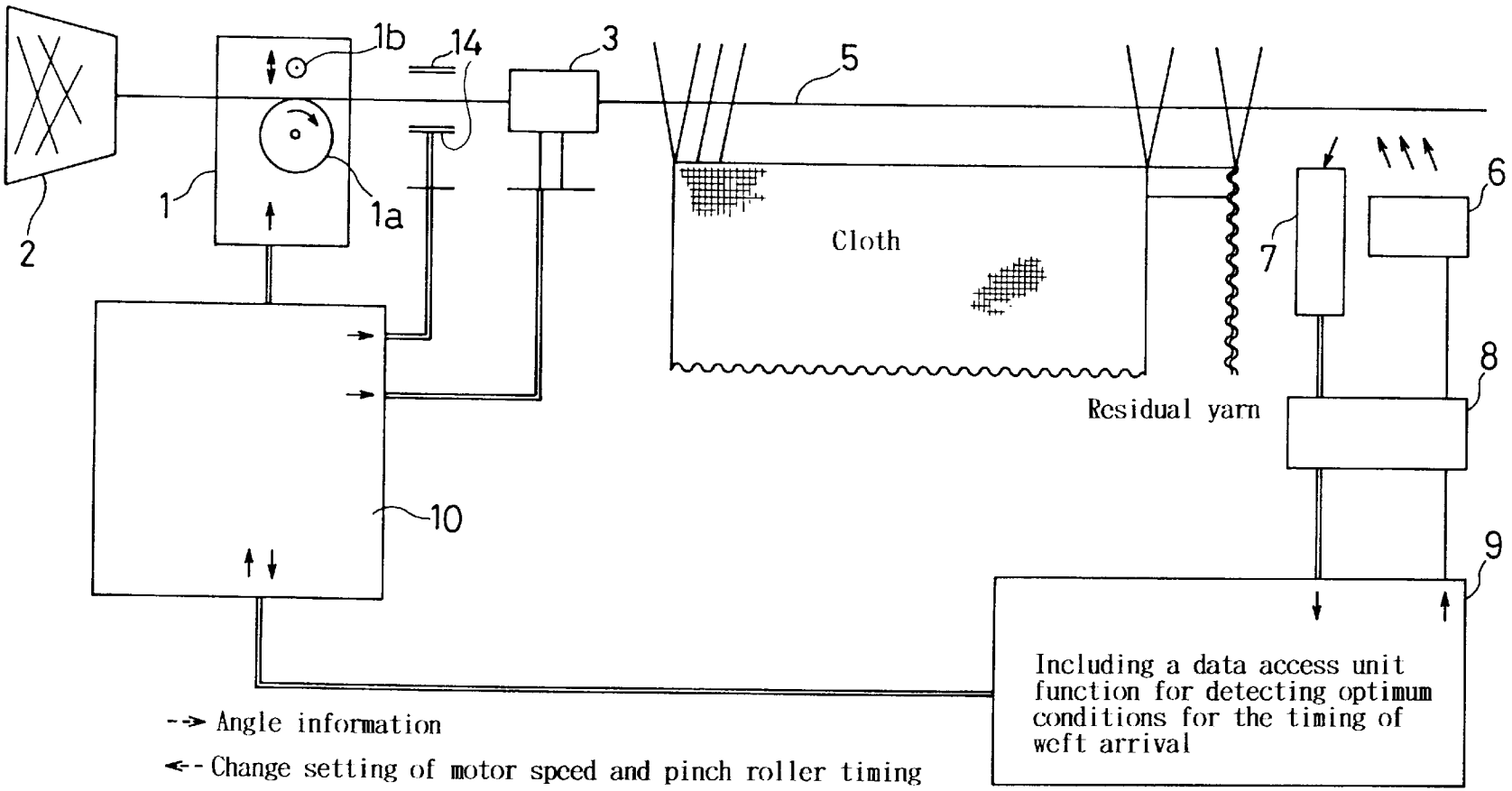
FIG. 1 is a conceptual diagram showing an embodiment of a weft control system of the present invention.
Figure 2:
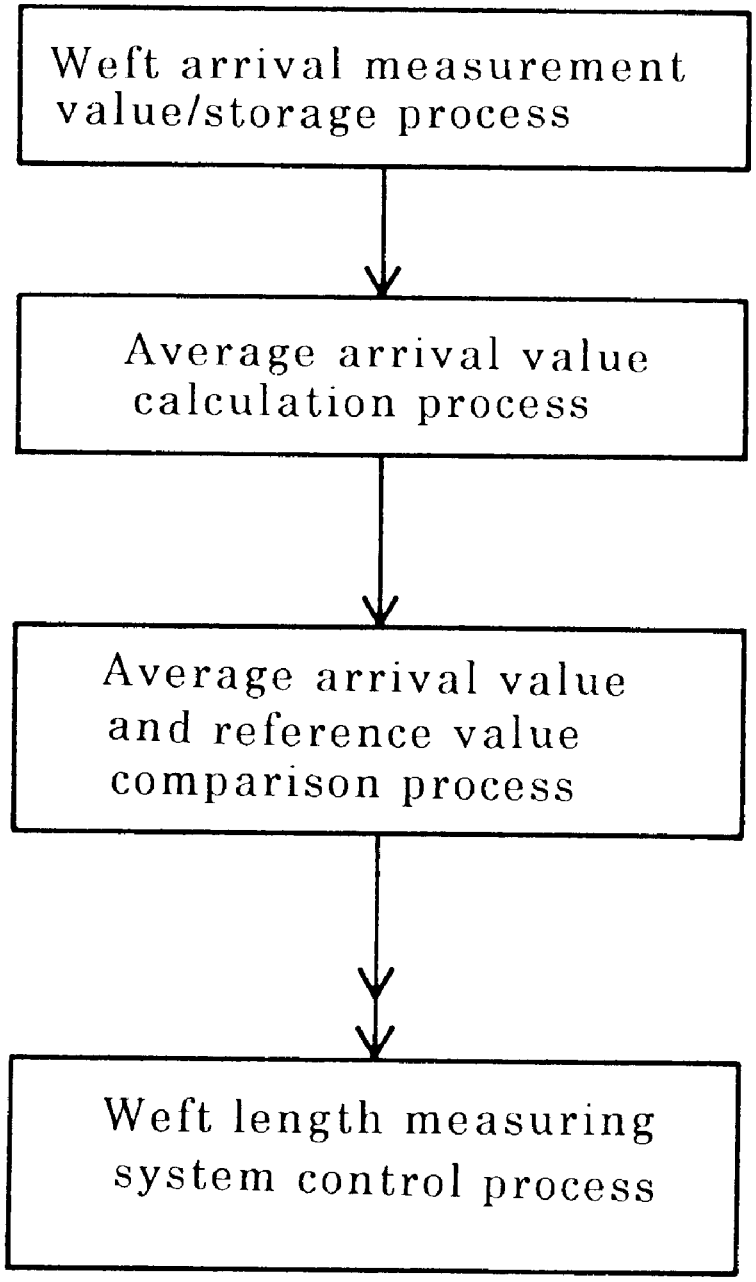
FIG. 2 is a block diagram of the weft control method of the present invention

An embodiment of the present invention is described below with reference to the attached drawings. FIG. 1 is a conceptual diagram of the weft control system of the present invention. FIG. 2 is a block diagram showing the control steps of the weft control method of the present invention.

In FIG. 1, reference numeral 1 is a weft length measuring unit comprising a length measuring roller 1*a*, which turns at a constant speed, and a pinch roller 1*b*, which contacts the roller at certain intervals. Reference numeral 2 is a yarn supply roll, 3 is a nozzle, and 4 is a gripper. Weft 5 is supplied from yarn supply roll 2, measured at a certain length at the weft length measuring unit 1 which comprises a length measuring roller 1*a* and a pinch roller 1*b*, and is inserted into the shed through nozzle 3.

Further, in FIG. 1, reference numeral 6 is a projector, and 7 is a light receiving camera, which may be a CCD line sensor, for example. The projector 6 emits light once every certain angular rotation of the loom synchronously with weft insertion. The light receiving camera 7, synchronously operating with the projector 6, detects the leading edge of the weft that has arrived, and outputs pulse signals. A sensor controller 8 controls operation of the projector and the detector, and also rectifies and amplifies signals output from the detector.

The projector 6, light receiving camera 7 and sensor controller 8 may be replaced by conventional feeler sensors and amplifiers capable of detecting the arrival of the weft.

The main controller 9 stores the information on the angle of arrival of the weft output from the sensor controller 8, and calculates the average angle of arrival for a certain number of picks. The derived average angle of arrival is compared with the preset reference data. A command is then issued to re-write the program for the length measurement roller and pinch roller. In this instance, the ON angle or timing of the pinch roller is changed when a large change in the angle of arrival is necessary, while small changes are effected by changing the rotation frequency or rotation speed of the length measurement roller. The selection is determined by the program in the main controller 9. The weft length measurement control unit 10 re-writes the control data for the length measuring roller 1*a* and pinch roller 1*b* based on the control command received from the main controller 9.

When the data for the length measuring roller 1*a* are changed, the relevant change is input into the inverter for the length measuring roller 1*a* via a sequencer to change the rotation frequency of the length measuring roller 1*a*.

In a like manner, a change in the data for the pinch roller 1*b* will cause a change in the ON or OFF angle of the pinch roller 1*b* via the sequencer.

No automatic change of gripper 4 and nozzle 3 is required in the operation provided that they are set on an appropriate level respectively before the start of the operation.

The operation of the system is described below.

First, the following data are set for the weft length measuring unit:

Pinch roller 1*b* ON timing Dn/Df: 80 to 185°

Rotation frequency for length measuring roller 1*a* Fp: 142 Hz

Target value for weft arrive timing Dm: 220°

The loom is then operated under the above conditions. The weft arriving angle is stored for each and every pick based on the signals from the weft arrival sensors. An average arrival value is calculated for a certain number of picks (20 picks, for example). The average value is represented by Dh.

For Dh>Dm (the average arrival value is slower than the target value), the main controller 9 issues a command to increase the rotation frequency Fp for the length measuring roller 1*a*.

For average arrival value Dh 230° (target value 220°), for example, and Fp144 command is issued (initial setting 142 Hz).

For Dh<Dm (the average arrival value is faster than the target value), on the other hand, the main controller 9 issues a command to reduce the rotation frequency Fp for the length measuring roller 1*a*.

For the average arrival value Dh 210° (target value 220°), for example, an Fp140 command is issued.

When the difference between the average value Dh and the target value Dm is large, 10° or more, for example, the pinch roller 1*b* ON timing Dn/Df value is changed.

The weft feed rate can be controlled at a constant level at all times by repeating the above control.

The present invention is so constructed that the weft average arrival value, measured in the weft arriving position in the end portion of the loom, is compared with the reference target value and the result of comparison is used to control the operation of the length measurement roller or pinch roller via the weft length measurement control unit. Accordingly, it is possible to automatically and correctly adjust the weft feed rate without manual intervention of the weft feed length 9 which is necessary in the conventional systems. Furthermore, continuous, constant and stable adjustments are achieved, thereby alleviating fluctuations resulting from occasional extraordinary weft insertions, because the average value calculated for a certain number of picks is used as the measurement value to be compared with the reference target value.

I claim:

1. A weft control method for looms having a weft length measuring unit comprising a length measuring roller and a pinch roller, a weft feeding unit comprising a gripper and a nozzle, and a weft arrival sensor installed in a weft arriving position in an end portion of the loom, the method comprising:

storing a weft arrival value measured by the weft arrival sensor;

calculating an average weft arrival value for a certain number of picks;

comparing the average weft arrival value with a preset reference target value; and changing an operation program for the length measuring roller and the pinch roller in accordance with the result of the comparison between the average weft arrival value and the preset reference target value.

2. The weft control method as claimed in claim 1, wherein said changing of the operation program comprises increasing a rotation frequency of the length measuring roller when the average arrival value is less than the preset reference target value.

3. The weft control method as claimed in claim 1, wherein said changing of the operation program comprises decreasing a rotation frequency of the length measuring roller when the average arrival value is greater than the preset reference target value.

4. The weft control method as claimed in claim 1, wherein said changing or the operation program comprises changing a timing of the pinch roller when a difference between the average arrival value and the preset reference target value is calculated to be at a weft arrival of least 10°.

* * * * *